US005645771A

United States Patent [19]

Sethna et al.

[11] Patent Number: 5,645,771

[45] Date of Patent: Jul. 8, 1997

[54] GAS INJECTION APPARATUS AND METHOD HAVING APPLICATION TO GOLD LEACHING

[75] Inventors: Rustam H. Sethna, New Brunswick; Atul M. Athalye, Chatham; Michael K. Sahm, Annendale, all of N.J.

[73] Assignee: The BOC Group, Inc., New Providence, N.J.

[21] Appl. No.: 531,988

[22] Filed: Sep. 21, 1995

[51] Int. Cl.[6] ..... B01F 3/04

[52] U.S. Cl. ..... 261/123

[58] Field of Search ..... 261/123

[56] References Cited

U.S. PATENT DOCUMENTS

| | | | |
|---|---|---|---|
| 1,441,560 | 1/1923 | Commors | 261/123 |
| 3,405,920 | 10/1968 | Lefrancois | 261/123 |
| 4,282,172 | 8/1981 | McKnight | 261/123 |
| 4,477,341 | 10/1984 | Schweiss et al. | 261/123 |
| 5,505,881 | 4/1996 | Eades et al. | 261/123 |

*Primary Examiner*—Tim R. Miles

*Attorney, Agent, or Firm*—David M. Rosenblum; Salvatore P. Pace

[57] ABSTRACT

A gas injection apparatus for injecting a gas into a liquid comprising a baffle plate, a re-circulation chamber, and a discharge nozzle. The discharge nozzle is oriented normally to the baffle plate so that a liquid stream composed of the liquid is directed against the baffle plate and produces an oppositely directed flow towards the outer peripheral edge of the baffle plate. The oppositely directed flow has a sheet-like turbulent flow regime located adjacent to the plate and a circulating flow regime located above the turbulent flow regime and bounded by a re-circulation chamber. The gas is mixed into the liquid so that smaller bubbles are entrained in the turbulent flow regime and are discharged with the liquid flowing in the turbulent flow regime from the outer peripheral edge of the baffle plate. Larger bubbles flow into the circulating flow regime to break up into smaller bubbles which are entrained in the turbulent flow regime swept out of the apparatus. The apparatus is particularly useful in a gold leaching process in which the gold slurry is thickened to produce clarified water. Oxygen is injected into the clarified water and thereafter, the clarified water is injected into a leaching tank.

9 Claims, 2 Drawing Sheets

GAS INJECTION APPARATUS AND METHOD HAVING APPLICATION TO GOLD LEACHING

BACKGROUND OF THE INVENTION

The present invention relates to a gas injection apparatus and method for injecting a gas into a liquid, for instance oxygen into an aqueous gold slurry. More particularly, the present invention relates to such injection apparatus in which a stream of liquid is directed against a plate to produce a sheet-like turbulent flow regime having entrained gas bubbles which are discharged with the turbulent flow from a peripheral region of the plate.

There are many industrial applications in which gases are injected into liquids. An example of such an application is water aeration. In water aeration, bacteria are destroyed by injecting oxygen into the water. In another application, involving mineral processing, oxygen is injected into a gold slurry in order to meet the oxygen requirements or demand of gold slurries. In the gold slurry application, oxygen is injected into the gold slurry from a lance. Spargers are also used for this purpose.

The problem with prior art methods of oxygen injection is that a high enough dissolved oxygen content is not obtained because of mass transfer inefficiencies. For instance, bubbles of oxygen coalescence to produce large bubbles. The larger bubbles have less of a surface area per unit volume than the smaller bubbles and hence the concentration of oxygen within the liquid is lower than had the bubbles not coalesced.

As will be discussed, the present invention provides a gas dissolution apparatus and method in which such mass transfer inefficiencies are overcome by preventing large-scale coalescence. Such gas dissolution apparatus has particular application to an improved gold slurry treatment.

SUMMARY OF THE INVENTION

The present invention provides a gas injection apparatus for injecting a gas into a liquid. In accordance with the gas injection apparatus, a baffle plate is provided having an outer peripheral region. A discharge nozzle is oriented normally to the baffle plate so that a fluid stream composed of at least the liquid is directed against the plate and produces an oppositely directed flow towards the outer peripheral region of the baffle plate. The oppositely directed flow has a sheet-like turbulent flow regime located adjacent to the plate and a circulating flow regime located above the turbulent flow regime and bounded by the recirculation chamber. A means is provided for mixing the gas into the liquid so that the smaller bubbles are entrained in the turbulent flow regime and are discharged with the liquid flowing in the turbulent flow regime from the outer peripheral region of the baffle plate. Larger bubbles float into the circulating flow regime to break up into the smaller bubbles that are entrained in the turbulent flow regime.

In another aspect of the present invention, a method is provided for injecting a gas into a liquid. In accordance with the method, a fluid stream composed of at least the liquid is discharged against the baffle plate to produce an oppositely directed flow having a flow direction towards an outer peripheral region of the baffle plate. The oppositely directed flow has a sheet-like turbulent flow regime located adjacent to the baffle plate and a circulating flow regime located above the turbulent flow regime. A gas is mixed into the liquid so that the smaller bubbles are entrained in the turbulent flow regime and are discharged from the outer peripheral region of the baffle plate. Larger bubbles flow into the circulating flow regime and breakup into the smaller bubbles to be entrained in the turbulent flow regime.

In accordance with yet another aspect of the present invention, a method of leaching gold is provided in which gold slurry containing the gold is thickened to produce thickened slurry. The thickened slurry is introduced into a leaching circuit and the oxygen is disbursed into the leaching circuit. This is accomplished by injecting water into the leaching circuit and by mixing the oxygen with the water prior to injection. The mixing and injection can be effectuated by the methodology and apparatus outlined above. Such methodology and apparatus allow for injection of the liquid from an external source of water or clarified water produced during the thickening process. There is less coalescence and more dispersion and dissolution of oxygen than prior art methods because the turbulent flow regime forms a gas-liquid sheet jet spread out over a large area to minimize bubble-bubble interactions.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
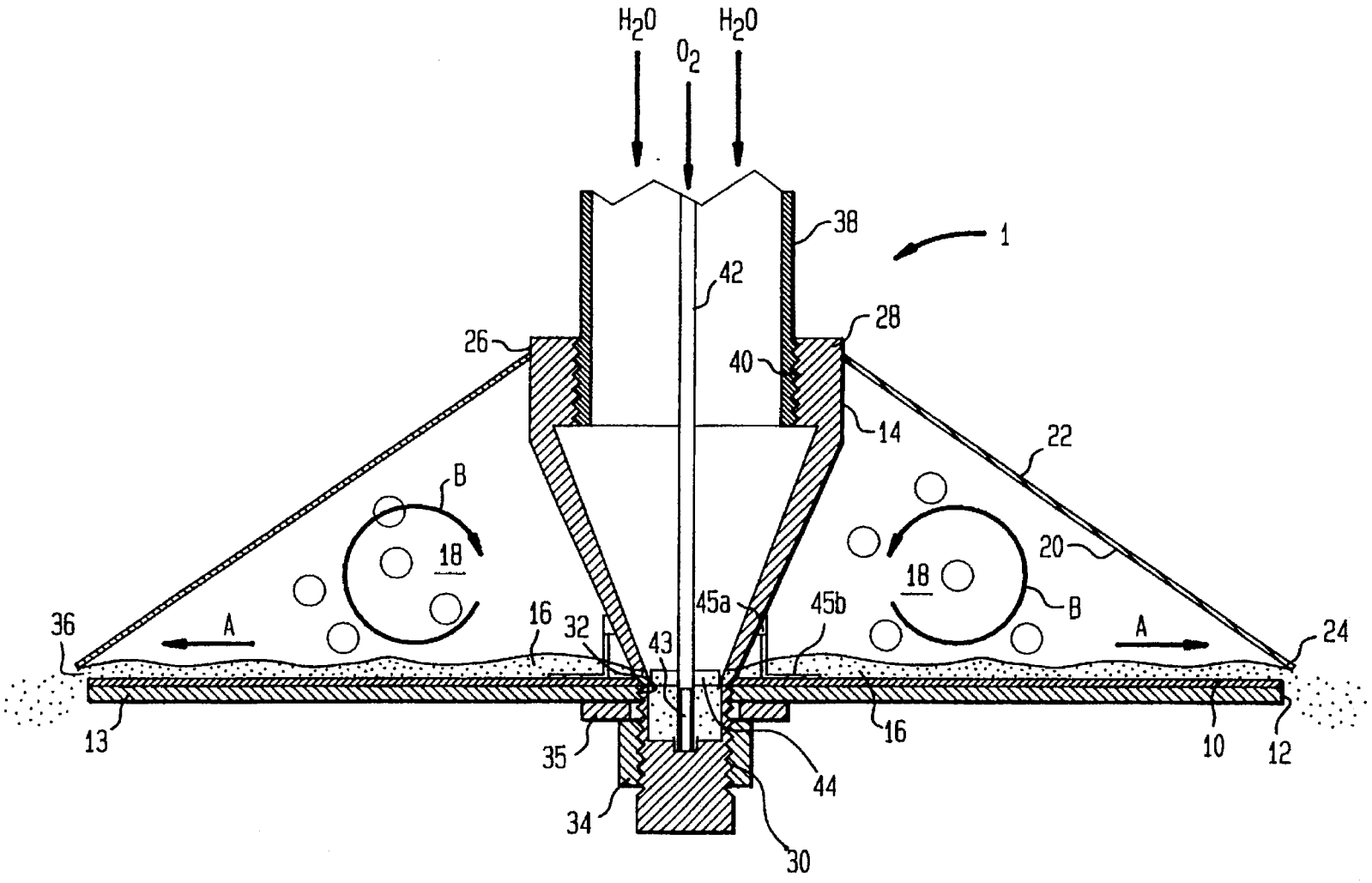
FIG. 1 is a schematic of a gas injection apparatus for carrying out a method in accordance with the present invention.

With reference to FIG. 1, a gas injection apparatus 1 in accordance with the present invention is illustrated. Gas injection apparatus 1 during use would be submerged within a liquid or a slurry in which a gas is to be injected.

Gas injection apparatus 1 is provided with a baffle plate 10, which in the illustrated embodiment, is of circular configuration. As such, it has a circular outer peripheral region defined by outer edge 12. It is understood, however, that baffle plate 10 could have a square or rectangular configuration. A set of four radially oriented ribs 13 are connected to the underside of baffle plate 10 for stiffening purposes. A discharge nozzle 14 is oriented normal to baffle plate 10 so that a liquid stream composed of the liquid is directed against baffle plate 10. This produces an oppositely directed flow, indicated by arrowheads A in the direction of outer peripheral edge 12. The term "oppositely directed flow", as used herein and in the claims means a flow which takes at least two opposite paths after colliding with baffle plate 10. Since baffle plate 10 is of circular configuration, an infinite number of radial paths is taken for the liquid towards outer edge 12. The oppositely directed flow has a sheet like turbulent flow regime 16 located adjacent to baffle plate 10 and a circulating flow regime 18 which is located above turbulent flow regime 16. The circulation of such flow is indicated by arrowhead B.

Larger bubbles rise out of turbulent flow regime 16 into circulating flow regime 18 and are broken up into small bubbles by the agitation produced by the circulation. The resultant small bubbles are re-entrained into turbulent flow regime 16. In such manner, small bubble size is maintained to provide the gas with a very large surface area to mix within the liquid. This fosters efficient dissolution of the gas within the liquid. It should be mentioned that the actual size of "small" bubbles will vary and depend on the particular application for apparatus 1. As such the term "small" is simply used to conveniently designate that the bubbles are smaller in the turbulent flow regime than bubbles that have coalesced to form "larger bubbles" to in turn be broken up in circulating flow regime 18.

Circulating flow regime 18 is preferably bounded by a recirculation chamber 20 formed by a frusto-conical recirculation plate 22. It has been found by the Inventors herein that although not absolutely necessary, improved operation is fostered by recirculation chamber 20 and recirculation plate 22. Re-circulation plate 22 has a circular outer peripheral edge 24 and an inner aperture 26 through which discharge nozzle 14 projects. Discharge nozzle 14 is welded in place within central aperture 26 and has an enlarged, internally threaded proximal end 28 which tapers to form an externally threaded distal end 30. Externally threaded distal end 30 projects through an opening 32 defined within baffle plate 10. Baffle plate 10 is in turn provided with a lock nut 34 welded to its underside and configured to treadably receive threaded distal end 30 of discharge nozzle 14. As illustrated, lock nut 34 bears against an annular element 35 which in turn bears against ribs 13. In such manner, discharge nozzle 14, at its threaded distal end 30, is connected to baffle plate 10 and recirculation plate 22 is fixed in position above baffle plate 10 to define an annular gap 36.

A supply tube 38 having a threaded end 40 is threaded into proximal end 28 of discharge nozzle 14 and a gas supply tube 42 coaxially projects through supply tube 38 and discharge nozzle 14. Gas supply tube 42 is connected to lock nut 34 and is provided with four opposed gas discharge openings in the form of four vertically oriented slots 43 to discharge gas into liquid being supplied through liquid supply tube 38. An embodiment is possible in which only a single gas discharge opening is provided in gas supply tube 42.

Discharge nozzle 14 is provided with opposed fluid discharge openings in the form of a set of four opposed, horizontally oriented slots 44 to discharge a mixture of liquid and small gas bubbles onto baffle plate 10 under conditions of turbulent flow to form the aforementioned turbulent flow regime As illustrated, horizontally oriented slots 44 are of rectangular configuration and are termed "horizontal" because they have a lengthwise orientation parallel to baffle plate 10. Thus, as discharge nozzle 14 is tightened or loosened into lock nut 34 or vice-versa, the open area of horizontally oriented slots 44 is adjusted. Such mechanism allows for some degree of control over the creation and extent of turbulent flow regime A.

Preferably, as an option, a clamp 45*a* is provided to connect a flexible cover 45*b* to discharge nozzle 14. Flexible cover 45*b* acts to cover horizontally oriented slots 44 when apparatus 1 is not in use or during turn-down conditions of operation.

Although not illustrated, a possible alternative embodiment of gas injection apparatus 1 would incorporate a perforated central area of baffle plate 10. A gas supply tube would be connected to the underside of baffle plate 10 and in registry with such perforated central area. In such an embodiment, there would be no lock nut 34 and discharge nozzle 14 would terminate in a discharge opening spaced above baffle plate 10 and aligned with the central perforated area. During operation, liquid would be discharged against baffle plate 10 and mix with gas escaping from the perforations.

Figure 2:
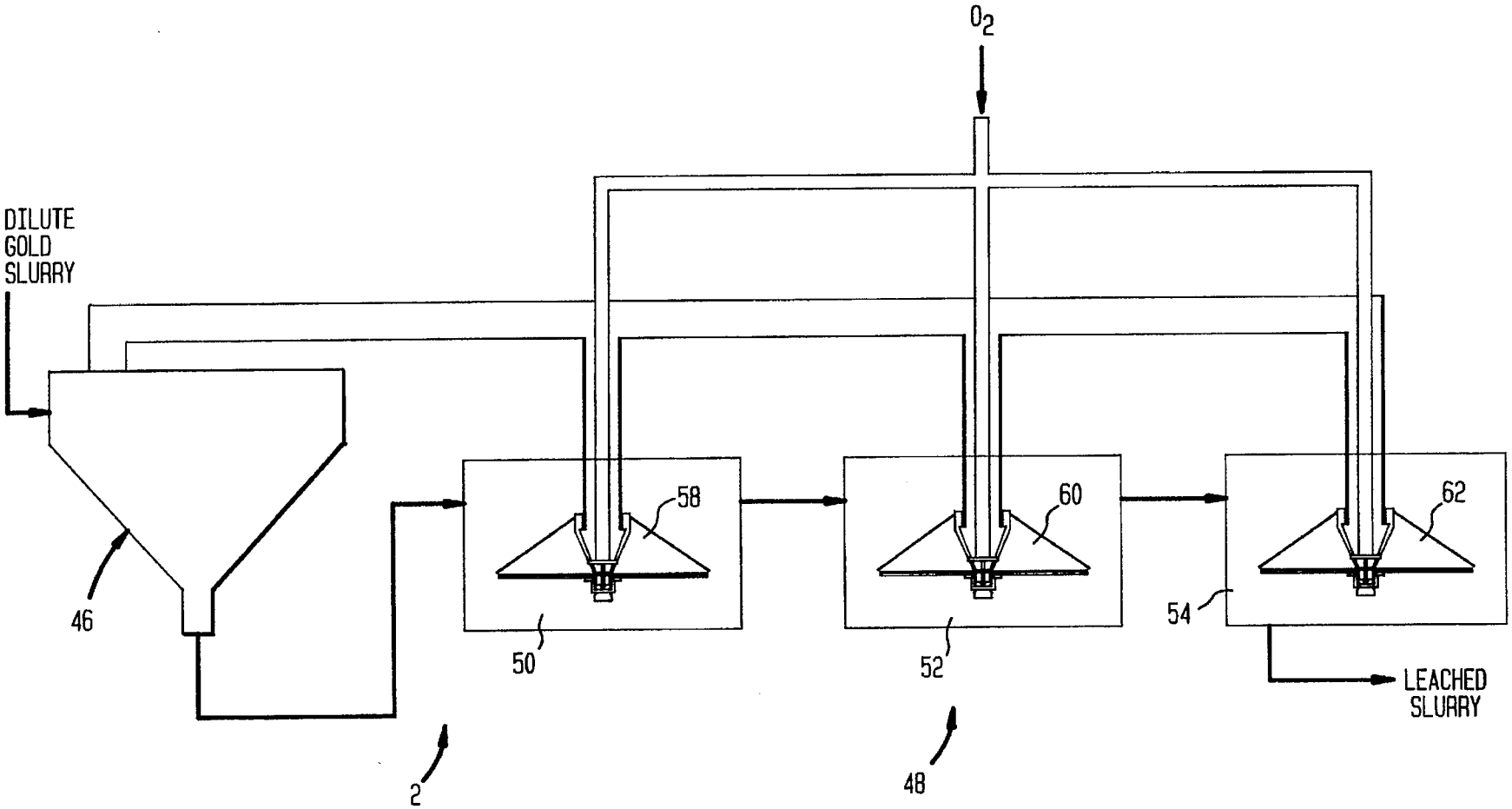
FIG. 2 is a schematic process representation generally setting forth a gold leaching process in accordance with the present invention.

With reference to FIG. 2, a gas injection apparatus 1 is illustrated in operation within a gold leaching system 2. Dilute gold slurry is introduced into a thickener 46 to produce thickened slurry which is discharged into leaching circuit 48 containing leaching tanks 50, 52, and 54. Leached slurry is discharged from leaching circuit 48. In the prior art, dilute slurry is thickened in the thickener so that it contains typically 50% by weight of solids in water. Although not illustrated, but as would be known to those skilled in the art, cyanide and lime is introduced into leaching circuit 48 to dissolve gold from the solid ore particles. Oxygen is introduced to oxidize interfering impurities and to reduce cyanide consumption.

The clarified water produced in thickener 46 is used as a source of liquid that is supplied to gas injection apparatus 58, 60, and 62 located within leaching tanks 50, 52, and 54. Each gas injection apparatus 58, 60, and 62 has the same design as gas injection apparatus 1. Oxygen is injected into clarified water which is in turn used to disburse small oxygen bubbles to the thickened slurry being processed within leaching circuit 48. While the dispersion of the gas into the thickened slurry is far superior to prior art injection and sparging techniques, some oxygen can be lost. Thus, although not illustrated, each leaching tank 50, 52, 54 could be provided with a hood to trap undissolved oxygen which could be reinjected into clarified water by preferably an external coaxial sheath surrounding each gas injection nozzle 14 employed within each gas injection apparatus 58, 60, and 62.

For exemplary purposes, assuming a slurry flow rate of about $2.0\times10^6$ kg per hour with a slurry density of solids being about 50.0% by weight and the solids having a density of about 2700.0 kg/m$^3$, the density of the slurry will be about 1,460.0 kg/m$^3$. If such slurry is slightly thickened so that the weight of solids rises to about 51.0%, the density of the slurry will be about 1,474.0 kg/m$^3$ and about 41,000.0 kg/hr of clarified water will be made available. If such slurry is further thickened so that the weight of solids is about 53.0%, the slurry density will increase to about 1,500.0 kg/m$^3$ and about 110,000.0 kg/hr of clarified water will be made available.

The extra clarified water can be added back to the leaching circuit 48 and distributed across leaching tanks 50, 52, and 54 depending on the oxygen demands of the individual tanks (as dictated by leaching process requirements). By way of example, slurry containing about 50.0% by weight of solids is thickened within thickener 46 to about 53.0% by weight of solids. Leaching tanks 50 and 52 each require about 120.0 kg./hr of oxygen and leaching tank 54 requires about 82.0 kg/hr. of oxygen. In such example the gas dispersion devices are designed to handle a gas-to-liquid actual volumetric ratio of about 1.0. If the static pressure due to slurry height at the depth of gas injection is about 2.4 bar on the average, then the excess clarified water is distributed to each gas injection apparatus 58 and 60 at the rate of about 41,000.0 kg/hr and excess clarified water is introduced into gas injection apparatus 62 at the rate of about 28,000.0 kg/hr. Valves can be provided in the appropriate lines of system 2 for such purpose. As a result, the slurry entering leaching tank 52 is about 51.8% by weight of solids and the slurry entering leaching tank 54 is about 50.7% by weight of solids. The slurry discharged from leaching tank 54 is about 50% by weight of solids.

It has been found by the inventors herein that the use of electrolytes, for example salt solutions, can greatly increase the mass transfer rate. In a gold leaching operation, normally the slurry contains salt and no additional salt need be added.

However, if the particular slurry is deficient in salts then salts can be added. The concentration of the salts in an aqueous solution for such purpose should be no less than 1.0 grams per liter. In applications for apparatus 1, other than gold leaching, electrolytes may also be added. The Inventors herein believe that the increased rate is the result of decreased bubble coalescence and smaller initial bubble size for a given gas flow rate. Thus, in case of oxygen dispersal into gold slurries enlarged tanks or pipelines or other gas injection needs, gas dissolution rates can be increased by increasing the electrolyte content of aqueous solutions. In this regard, the electrolytes include sodium or calcium chloride, sodium or calcium sulfate, and sodium or calcium hydroxide.

While the invention as been discussed with reference to preferred embodiment, as will occur to those skilled in the art, numerous additions, changes and omissions can be made without departing from the spirit or scope of the present invention.

We claim:

1. A gas injection apparatus for injecting a gas into a liquid comprising:

a baffle plate having an outer peripheral region;

a discharge nozzle to discharge at least said liquid;

said discharge nozzle oriented normally to said baffle plate so that a fluid stream composed of at least said liquid is directed against said plate and produces an oppositely directed flow, towards said outer peripheral regions of said baffle plate;

said oppositely directed flow having a sheet-like turbulent flow regime located adjacent to said plate and means forming a circulating flow regime located above said turbulent flow regime; and means for mixing said gas into said liquid so that smaller bubbles are entrained in said turbulent flow regime and are discharged with said liquid flowing in said turbulent flow regime from said outer peripheral region of said baffle plate and larger bubbles float into said circulating flow regime to break up into said smaller bubbles to be entrained in said turbulent flow regime.

2. The injection apparatus of claim 1, wherein:

said discharge nozzle is connected to said baffle plate and has opposed flow discharge openings located adjacent to said baffle plate for said oppositely directed flow to be discharged in a direction parallel to said baffle plate; and said mixing means comprises an internal, coaxial gas supply tube having at least one gas discharge opening located adjacent to said baffle plate for said small gas bubbles to be entrained in said liquid.

3. The gas injection apparatus of claim 2, wherein:

said baffle plate has a central opening;

said discharge nozzle has a threaded distal end projecting through said central opening and a locknut threaded onto said threaded distal end to connect said baffle plate to said discharge nozzle such that a depth that said threaded distal end projects through said baffle plate is adjustable by said adjustment of said locknut;

said flow discharge openings comprising a set of four, opposed horizontal slots having an open area size adjusted through adjustment of said locknut; and said at least one gas discharge opening comprise four, opposed vertical slots defined within said gas supply tube.

4. The gas injection apparatus of claim 1 or claim 3, further comprising a recirculation chamber overlying said baffle plate, spaced therefrom and bounding said circulating flow regime.

5. The gas injection apparatus of claim 4, wherein said baffle plate is of flat, planar configuration.

6. The gas injection apparatus of claim 4, wherein said outer peripheral region of said baffle plate defines a circle.

7. A method of injecting a gas into a liquid comprising:

discharging a fluid stream composed of at least said liquid against a baffle plate having at least one outer peripheral edge to produce an oppositely directed flow, having a flow direction towards said at least one outer peripheral edge of said baffle plate;

said oppositely directed flow having a sheet-like turbulent flow regime located adjacent to said plate and a circulating flow regime located above said turbulent flow regime; and mixing said gas into said liquid so that smaller bubbles are entrained in said turbulent flow regime and are discharged with said liquid flowing in said turbulent flow regime from an outer peripheral edge of said baffle plate and larger bubbles float into said circulating flow regime to break up into said smaller bubbles to be entrained in said turbulent flow regime.

8. The method of claim 7, further comprising adding an electrolyte to the liquid to increase mass transfer by decreasing bubble coalescence and lowering bubble size.

9. The method of claim 8, wherein said wherein said liquid comprises water and said electrolyte has a concentration within said water of no less than 1.0 gram per liter.

* * * * *